US010619389B2

(12) United States Patent
Mainini et al.

(10) Patent No.: US 10,619,389 B2
(45) Date of Patent: Apr. 14, 2020

(54) PET DOOR HAVING INSULATING FLAP

(71) Applicant: Radio Systems Corporation, Knoxville, TN (US)

(72) Inventors: Christopher E. Mainini, Knoxville, TN (US); Bill Groh, Knoxville, TN (US)

(73) Assignee: RADIO SYSTEMS CORPORATION, Knoxville, TN (US)

( * ) Notice: Subject to any disclaimer, the term of this patent is extended or adjusted under 35 U.S.C. 154(b) by 132 days.

(21) Appl. No.: 15/834,963

(22) Filed: Dec. 7, 2017

(65) Prior Publication Data

US 2018/0195326 A1 Jul. 12, 2018

Related U.S. Application Data

(60) Provisional application No. 62/436,907, filed on Dec. 20, 2016.

(51) Int. Cl.

| | |
|---|---|
| ***E06B 7/28*** | (2006.01) |
| ***E05C 19/16*** | (2006.01) |
| ***E06B 7/32*** | (2006.01) |
| ***E06B 1/52*** | (2006.01) |
| *E06B 3/80* | (2006.01) |

(52) U.S. Cl.

CPC ..... *E05C 19/16* (2013.01); *E06B 1/52* (2013.01); *E06B 7/32* (2013.01); *E06B 3/80* (2013.01)

(58) Field of Classification Search

CPC ... E05C 19/16; E06B 1/52; E06B 7/32; E06B 3/80

USPC ..... 49/168, 170, 169; 160/180

See application file for complete search history.

(56) References Cited

U.S. PATENT DOCUMENTS

| | | | |
|---|---|---|---|
| 318,812 | A | 5/1885 | Smith et al. |
| 539,394 | A | 5/1895 | Poulson |
| 1,189,790 | A | 7/1916 | Carroll et al. |
| 1,211,762 | A | 1/1917 | Sawyer et al. |
| 2,247,598 | A | 7/1941 | Bohlen et al. |
| 2,560,661 | A | 7/1951 | Poovey |
| 2,758,646 | A | 8/1956 | Johnson et al. |

(Continued)

FOREIGN PATENT DOCUMENTS

| | | | |
|---|---|---|---|
| CN | 205577779 | U | 9/2016 |
| GB | 2236135 | B | 8/1993 |
| GB | 2406874 | A | 4/2005 |

OTHER PUBLICATIONS

Chainlink Box Dog Kennel available from PetSafe, accessed on Sep. 11, 2013 from www.petfenceusa.com, 1 page.

(Continued)

*Primary Examiner* — Jerry E Redman

(74) *Attorney, Agent, or Firm* — Baker, Donelson, Bearman, Caldwell & Berkowitz PC

(57) ABSTRACT

A pet door is provided having a frame unit and a pivotal flap. The pet door includes a sill which is magnetically biased to attach to the lower end of the flap unit so as to maintain the flap unit in its closed position and to resist pressure differential forces applied to the flap unit, but to provide a lower degree of resistance at one or both of lower corners of the flap unit. The sill includes a first latch member extending from the sill which cooperates with a second latch member coupled to the bottom of the flap unit. At least one of the latch members may be frusto-conical in shape.

23 Claims, 12 Drawing Sheets

(56) References Cited

U.S. PATENT DOCUMENTS 2,789,531 A 4/1957 Diefendorf
2,892,562 A 6/1959 Smithson
3,675,402 A 7/1972 Weed et al.
3,738,322 A 6/1973 Smith
3,774,929 A 11/1973 Stanley
3,978,616 A 9/1976 Pennock
4,022,263 A * 5/1977 Beckett ..... E06B 7/32 160/92
4,170,312 A 10/1979 Lloyd et al.
4,216,743 A * 8/1980 Cohen ..... E06B 7/32 119/484
4,224,899 A 9/1980 Cruchelow et al.
4,256,056 A 3/1981 Sou
4,322,913 A * 4/1982 Himmer ..... E06B 7/32 49/168
4,408,416 A 10/1983 Davlantes et al.
4,421,058 A * 12/1983 Paul ..... G07C 9/0073 119/484
D287,650 S 1/1987 Braeuner
4,651,793 A 3/1987 Davlantes et al.
4,696,259 A 9/1987 Fewox
4,754,797 A 7/1988 Sronce et al.
4,762,085 A 8/1988 Ondrasik
4,776,133 A 10/1988 Green et al.
4,969,292 A * 11/1990 Reid ..... E06B 7/32 49/169
4,989,546 A 2/1991 Cannaday
4,991,350 A * 2/1991 Kirk ..... E06B 7/32 160/180
5,005,526 A 4/1991 Parker
5,123,377 A 6/1992 Edwards
5,167,202 A 12/1992 Bradford et al.
5,203,281 A 4/1993 Harwich
5,282,542 A 2/1994 Mo
5,287,654 A 2/1994 Davlantes et al.
5,364,458 A 11/1994 Burnett et al.
5,464,113 A 11/1995 Ho et al.
5,469,659 A * 11/1995 Reid ..... E05B 47/0038 160/180
5,469,807 A 11/1995 Kosmaczeska
5,479,892 A 1/1996 Edwards
5,535,804 A 7/1996 Guest et al.
5,581,940 A 12/1996 Peterson et al.
5,626,098 A 5/1997 Askins et al.
5,649,500 A 7/1997 Klavemann et al.
D382,374 S 8/1997 Burks
5,657,592 A 8/1997 Davlantes et al.
5,701,702 A * 12/1997 Reid ..... E05B 47/0038 160/180
5,701,813 A 12/1997 Smith et al.
5,735,079 A 4/1998 Davlantes et al.
5,785,003 A 7/1998 Jacobson et al.
5,845,970 A 12/1998 Schwartz
5,890,455 A 4/1999 Donchey
5,931,326 A 8/1999 Weng
5,938,057 A 8/1999 Cramer et al.
5,946,855 A 9/1999 Miconi et al.
5,946,856 A 9/1999 Davlantes et al.
5,960,744 A 10/1999 Rutman
5,967,090 A 10/1999 Hui
5,992,096 A * 11/1999 De La Cerda ..... E05F 15/76 160/180
D427,730 S 7/2000 Powers
6,141,911 A * 11/2000 Reid ..... E06B 7/32 292/142
D442,748 S 5/2001 Farrugia
6,272,793 B1 8/2001 Davlantes et al.
6,297,739 B1 * 10/2001 Small ..... A01K 1/035 340/572.1
6,354,245 B1 3/2002 Roddy et al.
6,385,909 B1 * 5/2002 Marsh ..... E06B 7/32 49/168
6,464,745 B2 10/2002 Rivera et al.
6,601,723 B1 8/2003 Ziglar
6,691,483 B2 2/2004 Lethers et al.
6,694,918 B2 2/2004 Draft
6,959,511 B2 * 11/2005 Johnson ..... E06B 7/32 160/180
6,966,147 B2 * 11/2005 Solowiej ..... A01K 1/035 49/169
7,063,123 B2 6/2006 Lethers et al.
7,150,244 B2 12/2006 Dawes et al.
7,152,371 B2 * 12/2006 Vaccari ..... E06B 7/32 49/169
7,159,361 B1 1/2007 Hale, Jr. et al.
7,197,848 B2 4/2007 Vaccari et al.
7,207,141 B2 4/2007 Sullivan et al.
7,284,502 B1 10/2007 Dotter et al.
7,363,956 B2 4/2008 Lethers et al.
7,765,955 B2 * 8/2010 Brooks ..... E05B 17/22 119/165
7,798,103 B2 9/2010 Bosserdet, Jr. et al.
7,866,769 B2 1/2011 Ahlgrim et al.
7,886,486 B2 2/2011 Lomax et al.
7,928,302 B2 4/2011 Sandson
8,430,795 B2 4/2013 Publicover et al.
8,434,264 B2 5/2013 Bosserdet, Jr. et al.
8,464,663 B2 * 6/2013 Kodat ..... E06B 7/32 119/484
8,595,976 B1 * 12/2013 Solowiej ..... E06B 7/32 49/169
8,783,801 B2 7/2014 Kaplan et al.
8,839,556 B2 * 9/2014 Brooks ..... G07C 9/00309 49/163
8,854,215 B1 * 10/2014 Ellis ..... E06B 7/32 340/573.1
8,917,172 B2 * 12/2014 Charych ..... A01K 15/023 340/10.1
9,145,731 B1 9/2015 McCoy et al.
9,157,269 B2 * 10/2015 Brown ..... E06B 7/32
9,284,773 B1 * 3/2016 Fridley ..... E06B 7/32
10,223,850 B2 * 3/2019 Sample ..... G06K 7/10148
2005/0252622 A1 * 11/2005 Reid ..... E06B 7/32 160/180
2005/0274463 A1 * 12/2005 Becker ..... E06B 7/32 160/98
2006/0011144 A1 * 1/2006 Kates ..... A01K 15/02 119/719
2006/0011146 A1 * 1/2006 Kates ..... A01K 15/02 119/719
2006/0252366 A1 * 11/2006 Eu ..... A01K 1/0017 455/3.06
2007/0175097 A1 * 8/2007 Thorne ..... E06B 7/32 49/169
2007/0204514 A1 9/2007 Grimmett et al.
2007/0204803 A1 * 9/2007 Ramsay ..... A01K 15/021 119/720
2007/0234643 A1 * 10/2007 Siegal ..... E05D 13/1284 49/360
2010/0126071 A1 * 5/2010 Hill ..... E06B 7/32 49/70
2010/0242854 A1 * 9/2010 Seger ..... E06B 7/32 119/484
2010/0269413 A1 10/2010 Sullivan et al.
2011/0192356 A1 * 8/2011 Loosveld ..... A01K 1/0023 119/840
2013/0305609 A1 * 11/2013 Graves ..... E05B 47/0012 49/168

OTHER PUBLICATIONS

Cottageview Dog Kennel available from PetSafe, from www.wag.com, accessed on Sep. 11, 2013, 1 page.
Extended European Search Report for Application No. EP17208380 dated May 17, 2018, 8 pages.
Ideal Pet Aluminum Modular Pet Patio Door [retrieved on Dec. 22, 2015] Retrieved from the Internet: (URL: http://www.idealpetproducts.com).
International Search Report and Written Opinion for Application No. PCT/US2018/46942, dated Nov. 1, 2018, 11 pages.

(56) References Cited

OTHER PUBLICATIONS

Lucky Dog Chain Link Boxed kennel available from Walmart, from www.walmart.com, accessed on Sep. 11, 2013, 1 page.
Lucky Dog Welded Wire Kennel available from Walmart, from www.walmart.com, accessed on Sep. 11, 2013, 1 page.
Options Plus Welded Wire Kennel available from HayNeedle, from www.hayneedle.com, accessed on Sep. 11, 2013, 1 page.
PetSafe Freedom Patio Panel [retrieved on Dec. 16, 2015] Retrieved from the Internet: (URL: http://www.petsafe.net).
PetSafe Sliding Glass Pet Door [retrieved on Dec. 22, 2015] Retrieved from the Internet:(URL: http://www.petsafe.net).
Precision Pet Kennel available from PetCo., from www.petco.com, accessed on Sep. 11, 2013, 1 page.

* cited by examiner

Fig. 9B
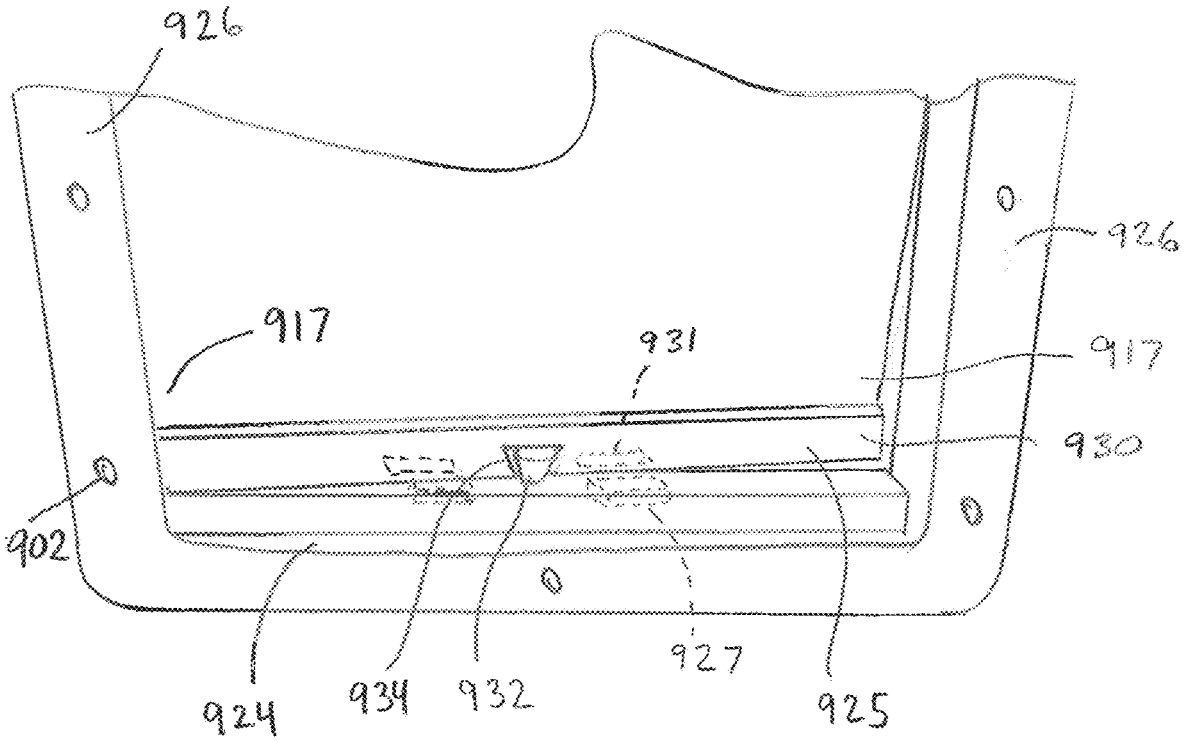
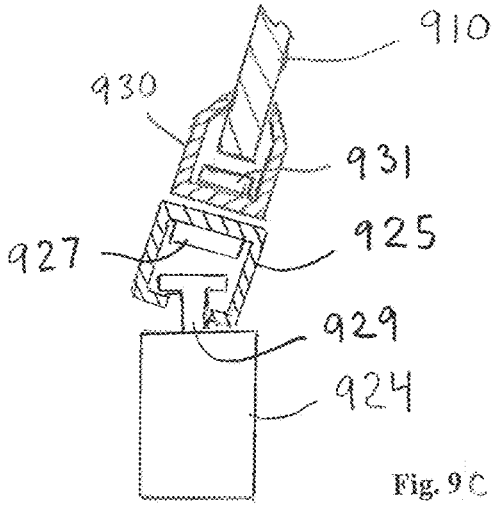
Fig. 9C

PET DOOR HAVING INSULATING FLAP

CROSS REFERENCE TO RELATED APPLICATIONS

This application claims the benefit of U.S. Provisional Patent Application Ser. No. 62/436,907 filed Dec. 20, 2016 and entitled Pet Door Having Insulating Flap.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

BACKGROUND OF THE INVENTION

This section is intended to introduce various aspects of the art, which may be associated with exemplary embodiments of the present disclosure. This discussion is believed to assist in providing a framework to facilitate a better understanding of particular aspects of the present disclosure. Accordingly, it should be understood that this section should be read in this light, and not necessarily as admissions of prior art.

FIELD OF THE INVENTION

The present inventive concept relates to the field of pet doors. More particularly, the invention relates to a pet door having a pliable flap, wherein the flap is heavily biased towards a closed position yet may still be opened by a pet for ingress and egress.

TECHNOLOGY IN THE FIELD OF THE INVENTION

Conventional pet doors are typically installed in a barrier, such as a residential door or wall, to enable a domestic pet to traverse through the barrier by way of the pet door. These pet doors oftentimes include a frame with a hinged flap or with a swinging door. The frame defines a passageway of sufficient size to allow a pet to pass through, and is typically installed by first cutting a through-opening in the structure. The frame cooperates with the structure at the through-opening such that, when the frame is installed, the passageway is defined at the through-opening to the extent that the passageway provides a passage through the structure.

The flap is disposed proximate the passageway and is movable between a closed position and an open position. When in the closed position, the flap substantially covers the passageway such that environmental elements do not pass there through. When in the open position, the flap permits the pet to pass through the passageway. The flexible flap member allows the pet to freely pass in and out as needed or desired.

Hinged door designs utilize either a pliable flap material or a rigid panel that insulates from heat and cold by maintaining a releasable seal around the edges of the frame. Various mechanisms are used to create this seal. These include rubber wipers and felt pads.

The flap itself is typically held in its closed (or sealed) position by gravity. In this respect, the weight of the hinged flap causes the flap to hang in its closed position below a hinge mechanism. Commonly, a magnetic attraction is formed by magnets in the flap, in the bottom sill of the frame, or both, to further bias the flap in its closed position.

A common deficiency of such designs is the occurrence of wind, which can either push or pull at the flap, causing the seal to be broken. In addition, differences in pressure between the inside of a residence and the outside can cause a hinged flap to be pushed or pulled. Even a slight crack in the seal can result in energy inefficiency and discomfort to residents as outside air is exchanged in the home.

It has further been observed that most pets (particularly dogs of at least average intelligence) develop a preferential side (right or left) for nudging a flap unit towards its open position. Therefore, it is offered herein to provide pet door arrangements that increase the bias of the holding mechanism to add resistance to wind forces or other pressure differential in the central area of the flap unit, that is, the area not preferred by the pet, thus adding to the holding efficacy.

The holding mechanisms of the present invention are designed to resist both straight and upward forces while allowing torsional forces originating only at the corners to release the hold.

A need therefore exists for an improved animal door wherein the seal of a hinged flap is maintained in the face of wind action or pressure differential, while allowing a trained pet to push the flap open.

BRIEF SUMMARY OF THE INVENTION

An improved pet door is provided herein. In one embodiment, the pet door comprises a first frame unit and a second opposing frame unit. The two frame units are designed to be placed on opposing surfaces of a structural barrier such as a wall or a door. The frame units are preferably configured to be secured to the wall or door by means of a mechanical fastener such as a bolt.

The pet door also has a flap unit. In one embodiment, the flap unit is pivotally secured to a horizontally-oriented bar placed at the top of one of the frame units. The flap unit is fabricated from a polymeric (or other flexible) material that may optionally be cut-to-size by the pet owner.

The pet door also has a holding mechanism. The holding mechanism is designed to resist pressure differential between inside and outside surfaces of the flap unit. The holding mechanism is automatically engaged when the pet door flap is at rest. The mechanism is easily released when a pet applies force to one of the lower corners of the flap in an effort to pass through the door.

The flap unit automatically re-engages the holding mechanism after the pet passes. A key aspect of the method is that the pet provides the releasing force through learning that the flap releases by applying pressure to one or the other of the sides of the flap, but not the center.

Beneficially, a pet can be trained (or indeed, self-trained) to open a pet door flap by using its head or nose to push at one side or the other side of the flap unit. This initial torsional force, twists the flap at the bottom to release the holding mechanism. When the flap is in its closed position, the holding mechanism resists straight wind force that can normally push the flap forward or back and/or "belly" the flap pulling it straight up at the bottom.

BRIEF DESCRIPTION OF THE DRAWINGS

So that the manner in which the present inventions can be better understood, certain illustrations, charts and/or flow charts are appended hereto. It is to be noted, however, that the drawings illustrate only selected embodiments of the inventions and are therefore not to be considered limiting of scope, for the inventions may admit to other equally effective embodiments and applications.

FIG. 9B is an enlarged view of a lower portion of the pet door of FIG. 9A. The floating sill is more clearly seen.

FIG. 9C is a cross-sectional view of a portion of the pet door of FIG. 9A.

DETAILED DESCRIPTION OF CERTAIN EMBODIMENTS

Definitions

As used herein, the term "corrugated" refers to any sinusoidal contour, or a ridges-and-trough contour.

As used herein, the term "crease" refers to any linearly indented feature or trough along a profile. The crease may or may not be perforated.

As used herein, the term "slidably mating" includes any telescoping configuration, or mortise-and-tenon configuration wherein one member receives at least a portion of another member.

As used herein, the term "pivoting" includes the use of a flexible or compliant member attached to a fixed member using fixed hardware.

As used herein, the term "ferro-magnetic element" refers to any material that interacts with a magnet. Non-limiting examples include iron (and iron alloys, including steel), nickel, cobalt, ferrite and cobalt. A "magnet," in turn, is any device that creates its own magnetic field.

For purposes of the present disclosure, it is noted that spatially relative terms, such as "up," "down," "right," "left," "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over or rotated, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

Description of Selected Specific Embodiments

Figure 1:
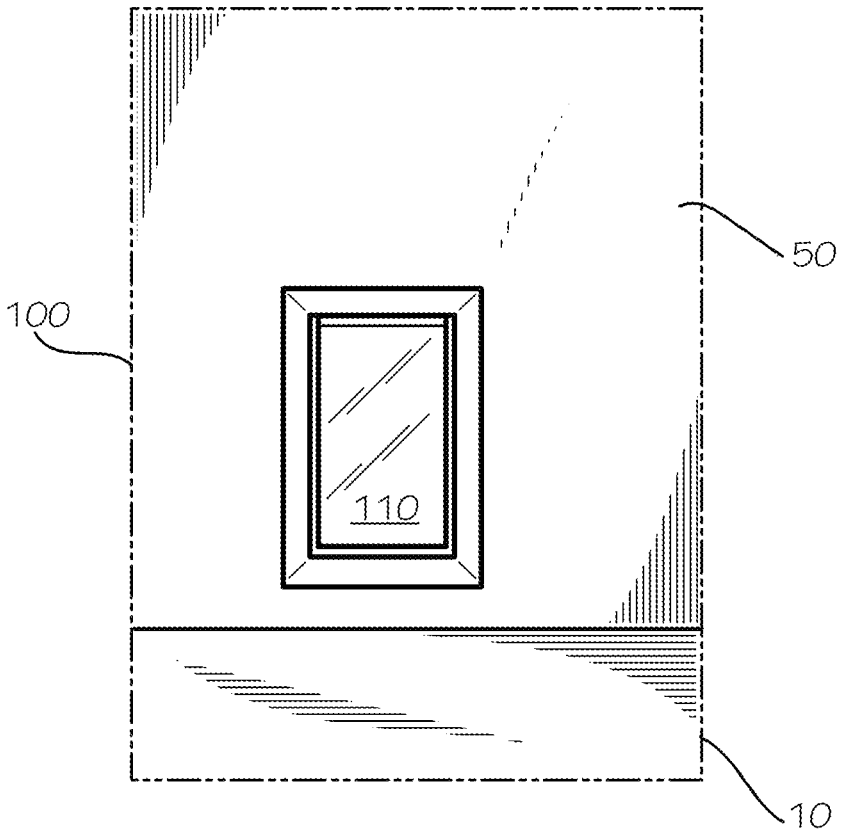
FIG. 1 (Prior Art)
FIG. 1 is a perspective view of an illustrative barrier, with a pet door having been installed therein. In this view, the barrier is a door. A pliable hinged flap is shown as part of the pet door.

FIG. 1 is a perspective view of an illustrative barrier 50. In this view, the barrier 50 is a door within a residence.

A pet door 100 has been installed within the barrier 50. A hinged flap 110 is shown as part of the pet door 100. The hinged flap 110 covers a through-opening (shown at 25 in FIG. 2A), providing at least some insulation for the house where the door 50 is hung relative to any ambient conditions present on the opposite side of the door 50.

In the arrangement of FIG. 1, the door is installed over a floor surface 10. The pet door 100 is positioned within the door 50 and above the floor surface 10 to allow a pet to step through the flap 110. Preferably, the flap 110 provides a means for the pet to leave a structure and to go outdoors.

Figure 2A:
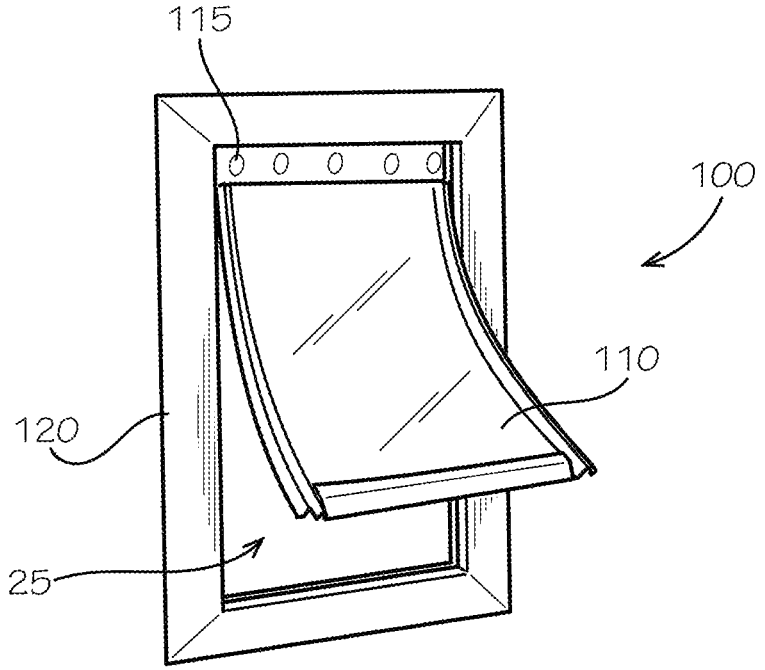
FIG. 2A (Prior Art)
FIG. 2A is a perspective view of the pet door of FIG. 1, having been removed from the barrier. Here, the pivoting motion of the pliable flap unit is seen.

FIG. 2A is a perspective view of the pet door 100 of FIG. 1. Here, the pet door 100 has been removed from the barrier 50 for illustrative purposes. It can be seen that the pet door 100 includes a frame 120. The frame 120 represents a four-sided polygon, and is typically fabricated from plastic or aluminum.

The pet door also includes the hinged flap 110. The pivoting motion and the pliable nature of the pliable flap unit 110 are seen.

Figure 2B:
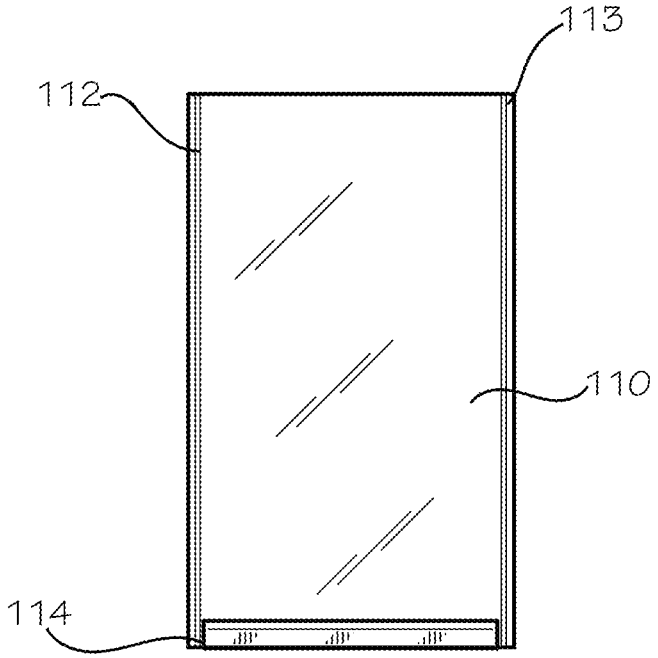
FIG. 2B (Prior Art)
FIG. 2B is a front view of the flap unit from the pet door of FIG. 1.

FIG. 2B is a front view of the flap unit 110 from the pet door 100 of FIG. 1. It is observed that the flap unit 110 includes an upper end 112 and a lower end 114. The upper end 112 contains a series of through-openings 113. These are dimensioned to receive pins (shown at 115 in FIG. 2A), which in turn pivotally connect the upper end 112 to the frame. The lower end 114 comprises a magnet. The magnet cooperates with a ferro-magnetic material placed along a bottom member of the frame 120 to bias the flap unit 110 in a closed position.

Figure 3A:
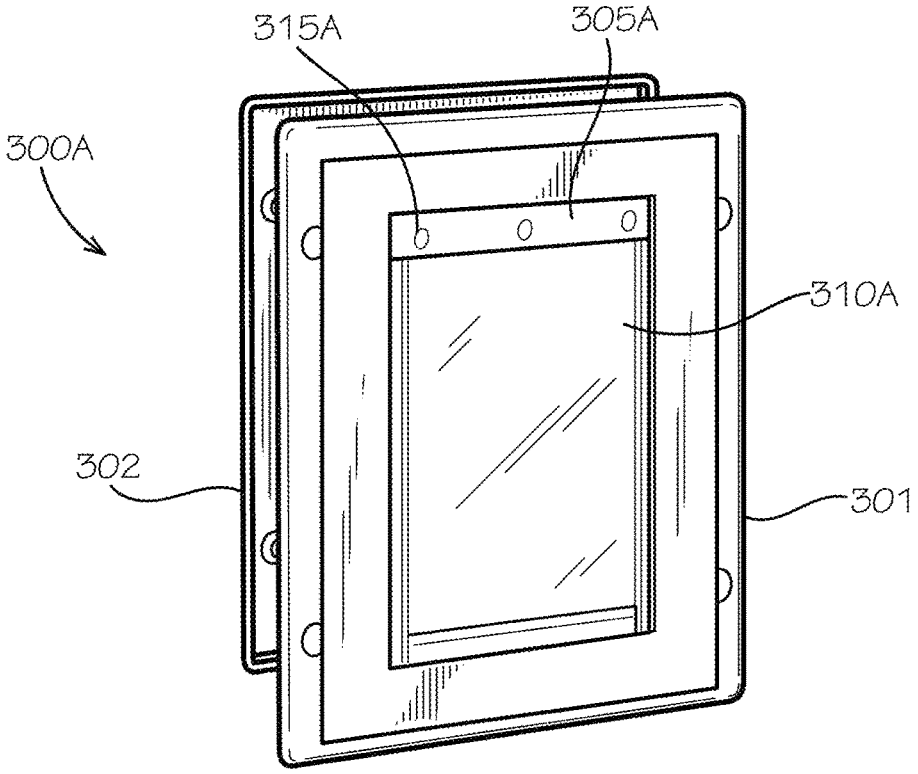
FIG. 3A is a perspective view of a pet door, in an alternate embodiment. This pet door employs separate frame units designed to be secured to opposing sides of a barrier. For the embodiment of FIG. 3A, the barrier is ideally a wall.

FIG. 3A is a perspective view of a pet door 300A, in a preferred form of the invention. The pet door 300A is shown installed within a barrier 50, shown in the form of a residential door above a floor surface 10. This pet door 300A employs two separate frame units designed to be secured to opposing sides of a barrier.

In the arrangement of FIG. 3A, the frame units represent a first frame unit 301 and a second frame unit 302. A pliable flap unit 310A is connected to a top frame member of the first frame unit 301 using a connection member 305A. The connection member 305A is simply a strip of material that secures an upper end of the flap unit 310A to the first frame unit 302 using screws or pins 315A.

Figure 3B:
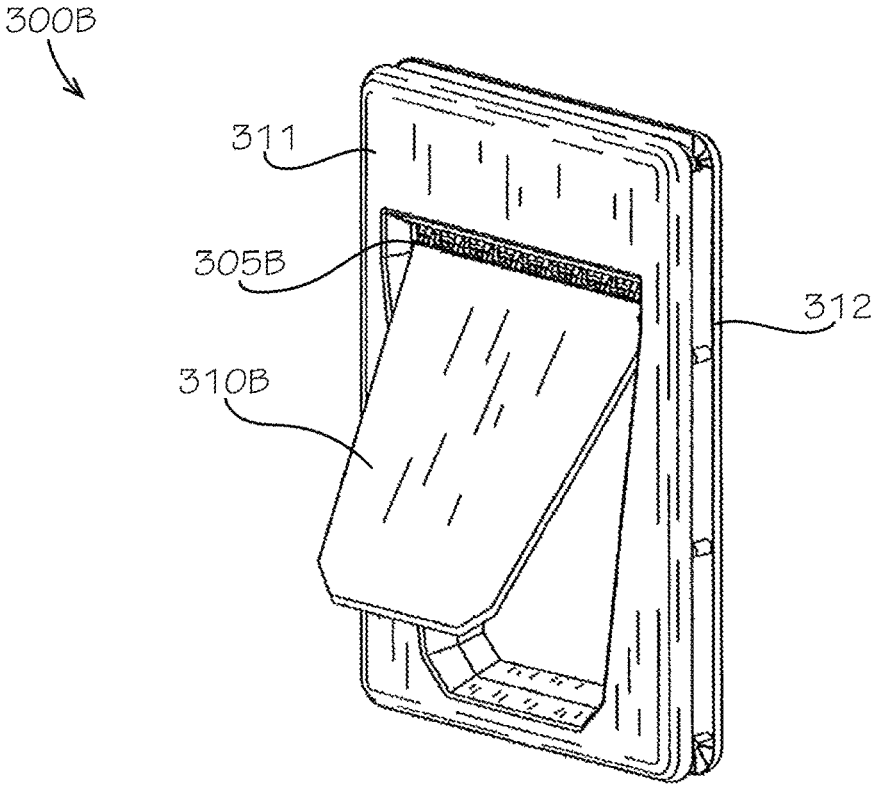
FIG. 3B is a perspective view of a pet door, in another alternate embodiment. This pet door also employs separate frame units designed to be secured to opposing sides of a barrier. For the embodiment of FIG. 3B, the barrier is ideally a door.

FIG. 3B is a perspective view of a pet door 300B, in another alternate embodiment. This pet door 300B also employs separate frame units designed to be secured to opposing sides of a barrier. For the embodiment of FIG. 3B, the barrier is ideally a door.

In the arrangement of FIG. 3B, the frame units represent a first frame unit 311 and a second frame unit 312. A flap unit 310B is connected to a top frame member of the first frame unit 311 using a pivoting connection member 305B. The connection member 305B is described more fully in U.S. Pat. No. 9,249,617, also owned by the applicant herein. U.S. Pat. No. 9,249,617 is entitled "Animal Door Having an Adjustable Resistance Against Being Opened," and is incorporated herein by reference in its entirety. It is noted that the flap unit 310B is a rigid member. This is not desirable for some embodiments of the present invention.

Figure 4:
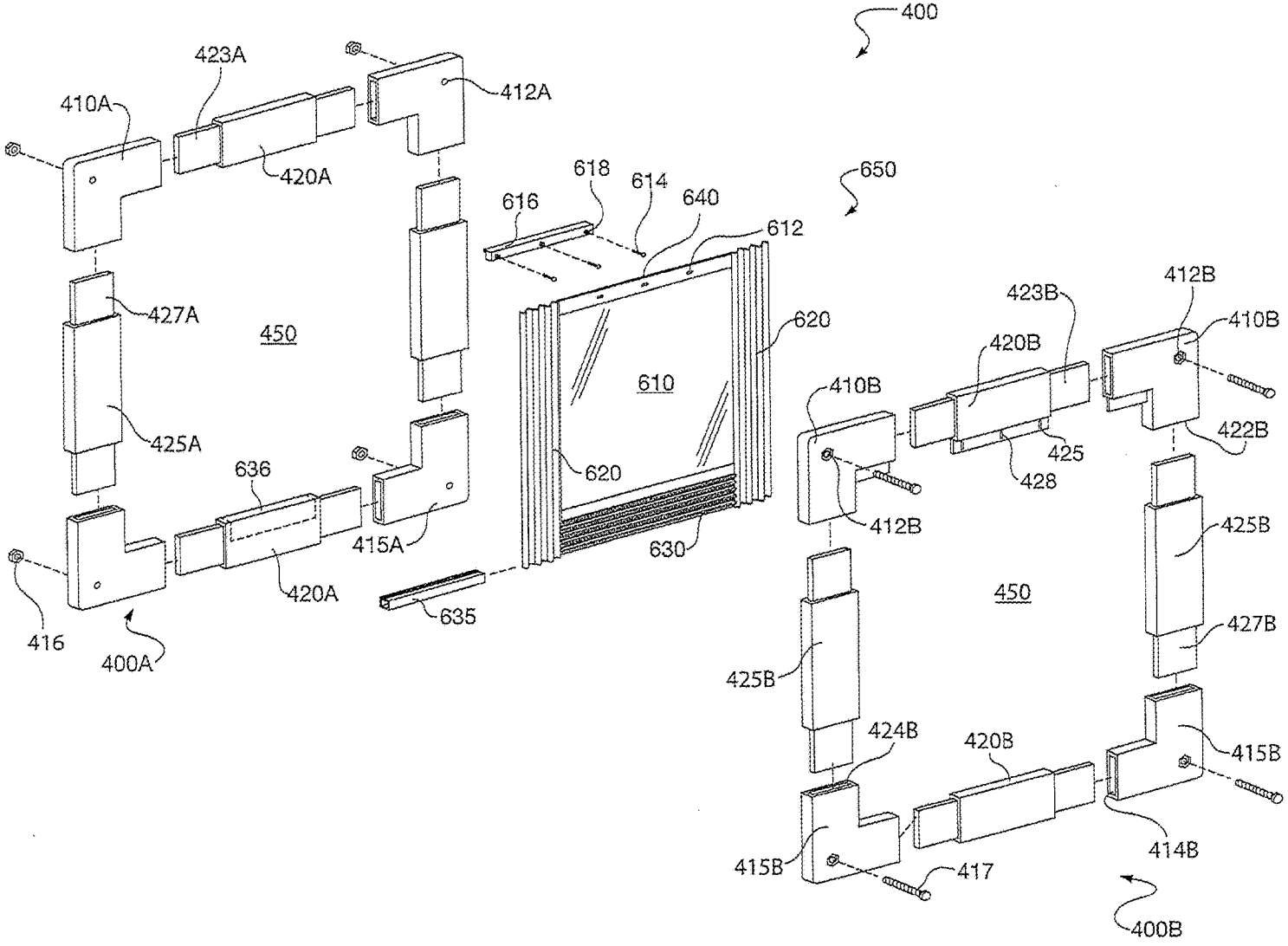
FIG. 4 is a perspective view of a pet door, in still another embodiment. The view shows first and second frame units, and an intermediate flap unit. The frame units and flap unit are shown in exploded-apart relation.

FIG. 4 is a perspective view of an animal door 400 in another embodiment. The view shows first 400A and second 400B frame units, and an intermediate flap unit 650. The frame units 400A, 400B and flap unit 650 are shown in exploded-apart relation.

Referring specifically to the second frame unit 400B, the second frame unit 400B comprises four separate floating corner pieces. The corner pieces include two upper floating corner pieces 410B and two lower floating corner pieces 415B. Each corner piece 410B, 415B defines a body forming a right angle, with each body having opposing right angle ends.

The second frame unit 400B also includes four bars. The bars include left and right opposing side bars 425B, and top and bottom bars 420B. The left and right side bars 425B are of the same length, and the top and bottom bars 420B are of the same length. In one aspect, the left and right side bars 425B and the top and bottom bars 420B are all of the same length. The top bar includes a flap mounting flange 425 having flap mounting holes 428 there through.

The left, right, top and bottom bars 425B and 420B, respectively, connect to corresponding generally right angle ends of the corner pieces 410B, 415B through slideable or telescopic connections, shown in the drawings as mortise-and-tendon type connections, to form right and left length adjustable bar members, and top and bottom length adjustable bar members. In the illustrative arrangement of FIG. 4, the tenons reside at opposing ends of the left and right side bars 425B, while the mortise openings reside within the right angle ends of the corner pieces 410B and 415B. The tenon portions of the left and right side bars 425B are shown at 427B, while the tenon portions of the top and bottom bars 420B are shown at 423B. The mortise openings are indicated at 414B and 424B.

It is understood that the mortise-and-tenon arrangement may be reversed. In this respect, the tenons may reside at the right angle ends of the corner pieces 410B, 415B, while the mortise openings may reside at opposing ends of the side bars 420B and 425B. In either aspect, the second frame unit 400B forms a collection of slidable or telescopic components. Sliding the components allows a pet owner, or pet door installer, to readily adjust a size of an opening 450 formed by the components of the frame unit 400B through relative positioning of the side bars 420B and 425B into the corner pieces 410B and 415B.

It is observed here that the first frame unit 400A is formed generally of the same slidable or telescopic components. Thus, floating corner pieces 410A, 415A correspond to floating corner pieces 410B, 415B; left and right side bars 425A correspond to left and right side bars 425B, and top and bottom bars 420A correspond to top and bottom bars 420B, thereby forming right and left bar members as well as top and bottom bar members.

The first 400A and second 400B frame units are designed to be coupled to each other so as to be fixedly attached to a structure, such as a residential door or wall.

Figure 5:
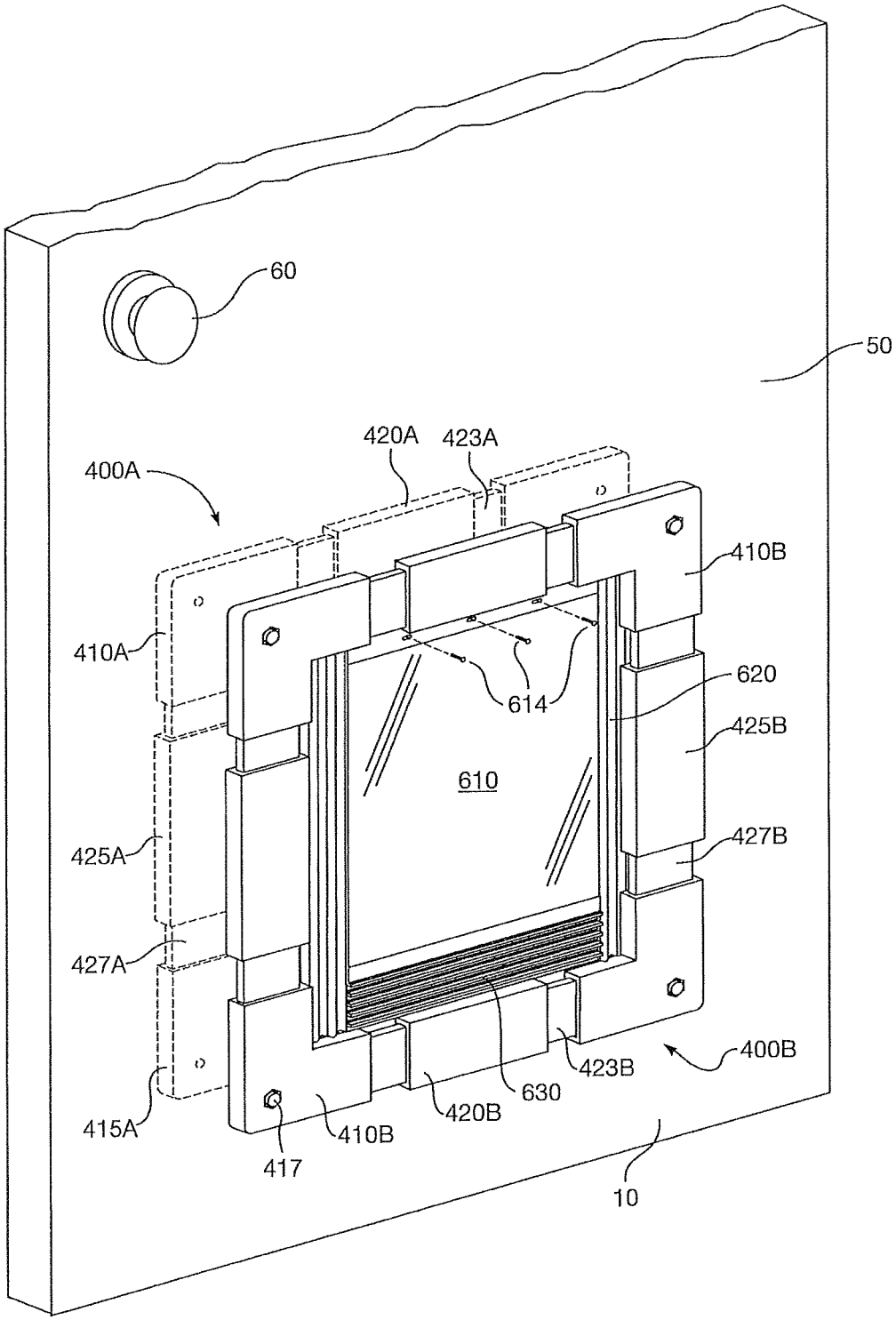
FIG. 5 is another perspective view of the animal door of FIG. 4. Here, the two frame units are affixed to opposing surfaces of a door. The frame units form an opening that aligns with a through-opening formed in the door.

FIG. 5 is another perspective view of the animal door 400 of FIG. 4. Here, the two frame units 400A, 400B are affixed to opposing surfaces of a residential door 50. The door 50 has a lower end 10 adjacent a floor (such as floor surface 10 in FIG. 1) and a door knob 60. The frame units 400A, 400B form an opening 610 (shown covered by flap unit 610) that aligns with a through-opening 450 (seen in FIG. 4) formed (typically by manually cutting) in the door 50.

In order to secure the first 400A and second 400B frame units to the residential door 50, one or more mechanical connectors 417 is provided, which are shown in the drawings in the form of pins or bolts 417. In the arrangement of FIGS. 4 and 5, bolts 417 are placed through mounting holes 412B in the corner pieces 410B, 415B. The bolts 417 extend through holes in the door 50 and through corresponding mounting holes 112A in the corner pieces 410A, 415A. Nuts 416 are then threaded onto the bolts 417 and tightened to provide a fixed connection to the residential door 50 there between.

As noted, the pet door 400 also includes a flap unit 650 coupled to the first 400A and second 400B frame units. The flap unit 650 is pivotally secured to the second frame unit 400B. Of course, it is understood that the flap unit 650 may alternatively be attached to the first frame unit 400A inasmuch as the first 400B and second 400A frame units are essentially interchangeable.

The flap unit 650 defines a flexible, planar surface fabricated from a pliable material such as polyethylene, natural rubber, polypropylene, iso-propylene or other elastomeric material.

The flap unit 650 includes a central panel 610 and two oppositely disposed side panels 620 extending laterally from the central panel 610. The central panel 610 has a top edge with three mounting holes 612 there through which are configured to align with flap mounting holes 628 within the flap mounting flange 625. (The flap mounting flange 625 extends down from upper bar 420B.) Each of the side panels 620 has a corrugated profile, forming a series of vertical creases 622. The corrugated profile of the side panels 620 allows the flap unit 650 to maintain an inherent spring property, biasing the central panel 310 outwardly when compressed.

The flap unit 650 further includes a bottom panel 630 extending downwardly from the central panel 610. The bottom panel 630 likewise includes a corrugated, or ridged, profile forming horizontal creases 632. Of interest, the left and right side panels 620 bound opposing ends of the bottom panel 630.

The creases in the left, right panels 620 and the bottom panel 630 form vertical and horizontal cutting guides, respectively, for the pet owner, or the pet door installer. In this way, the flap unit 650 may be cut to conform to the selected size of the opening 450 provided by the positioning of frame units 400A, 400B. It is understood that if the dimensions of the opening 450 are changed after installation, such as when a pet grows to a larger size or when a new pet is acquired, a new flap unit 650 will need to be cut and installed should the new opening 450 be longer and/or wider than the size of the original opening.

The flap unit 650 optionally includes a connection bar 616 having three mounting holes 618 therein. The mounting holes 618 are configured to align with central flap mounting holes 612. As such, mechanical fasteners, such as mounting bolts or screws 614 are passed through the flap mounting holes 628 of the flap mounting flange 625, through the mounting holes 612 of central panel 610, and threaded into mounting holes 618 of the central bar 616 to pivotally secure the flap unit 650 to the first frame unit 400B.

Lastly, the flap unit 650 includes a magnetic element 635 that engages the bottommost ridge of the bottom panel 630. The magnetic element 635 is magnetically drawn to a ferro-magnetic element 636 disposed in bottom bar 420B to bias the flap unit 350 to a flap-closed position.

Figure 6A:
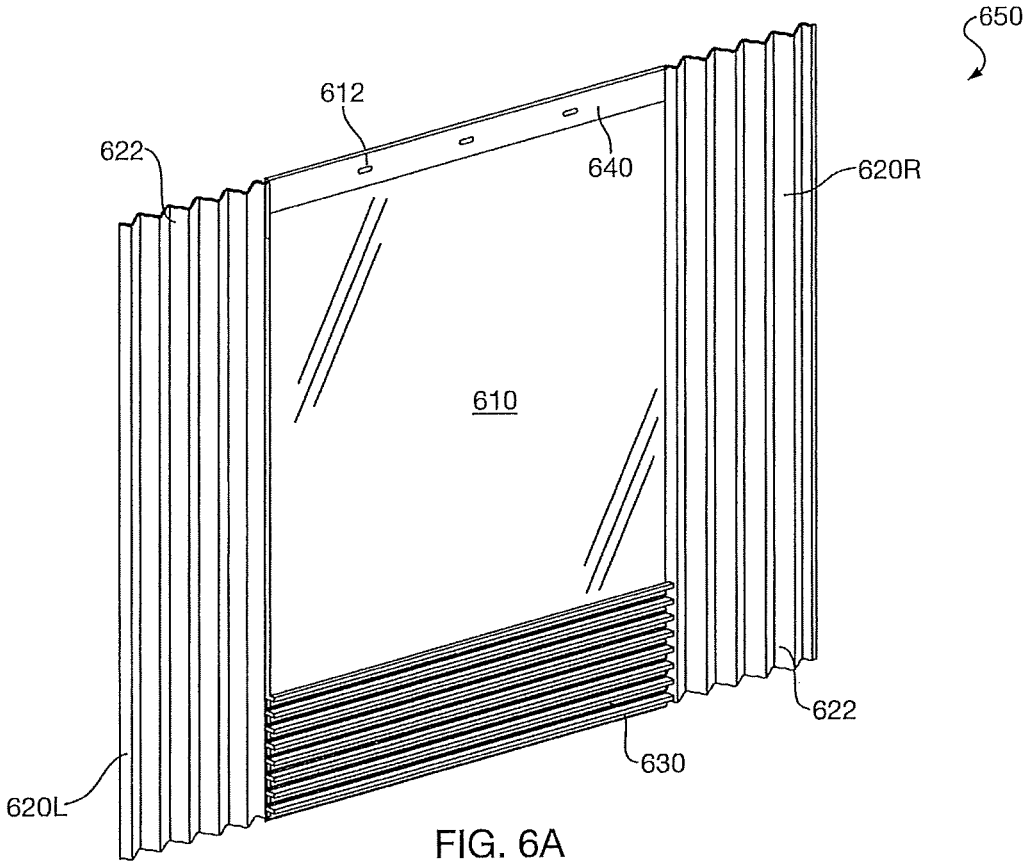
FIG. 6A is an enlarged perspective view of the flap unit of FIG. 4. Left and right side panels, and a bottom panel, are more clearly seen.

FIG. 6A is an enlarged perspective view of the flap unit 650 of FIG. 4. Left and right side panels 620L and 620R, and the bottom panel 630, are more clearly seen.

Figure 6B:
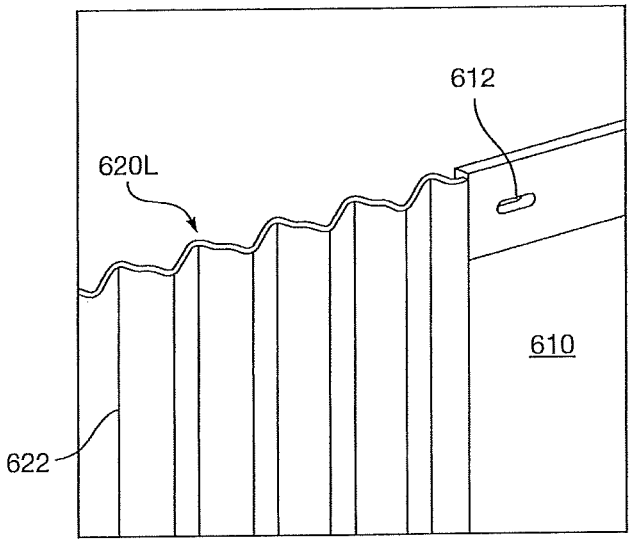
FIG. 6B is a further enlarged perspective view of the flap unit of FIG. 6A. Here, a corrugated profile of the left panel is more clearly seen.

FIG. 6B is a further enlarged perspective view of the flap unit 650 of FIG. 6A. Here, an illustrative corrugated profile of the left panel 620L is more clearly seen. Creases 622 along the left panel 620L are also more clearly seen. The creases 622 serve as pre-formed cutting guides for the pet owner.

Figure 7A:
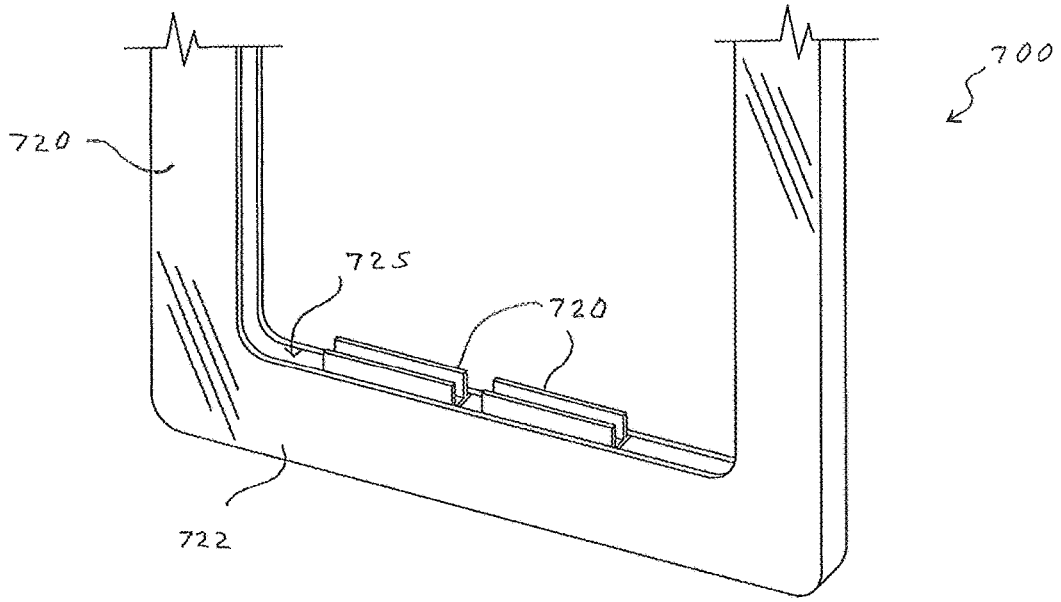
FIG. 7A is a perspective view of a bottom frame member of the pet door of the present invention, in one embodiment. The bottom frame member comprises a recess that holds a floating sill.

FIG. 7A is a perspective view of a portion of a pet door 700 of the present invention, in one embodiment. Specifically, a bottom portion 722 of a pet door frame 720 is shown. The bottom portion, or bottom frame member 722, comprises a channel or recess 735. The recess 735 is configured to hold a floating sill 730 which is vertically moveable within the recess 735. In the illustrative arrangement of FIG. 7A, two separate floating sills 730 are provided. The floating sills 730 are placed proximate a center portion of the bottom frame member 722.

Figure 7B:
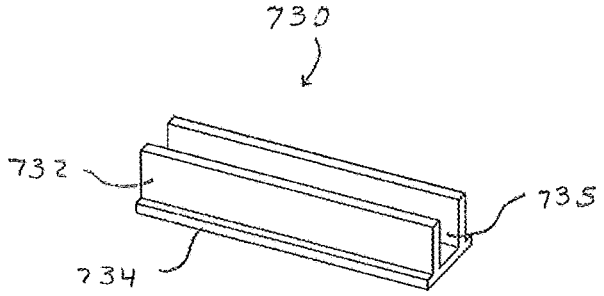
FIG. 7B is a perspective view of one of the floating sills of the pet door of FIG. 7A.

It is observed that the floating sills 730 represent generally u-shaped bodies. FIG. 7B is a perspective view of one of the floating sills 730 of the pet door of FIG. 7A. It can be seen that the floating sill 730 includes side walls 732 forming an elongated channel 735. The channel 735 is dimensioned to receive the bottom magnetic portion of a flap unit, such as bottom end 114 of FIG. 2B or bottom end 630 of FIG. 4.

Figure 7C:
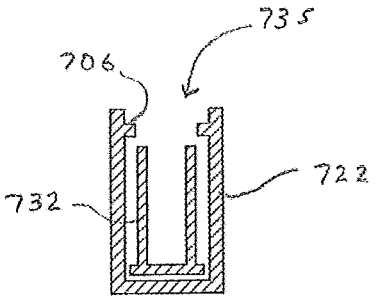
FIG. 7C is a cross-sectional view of the bottom frame member of FIG. 7A, showing a floating sill therein.

FIG. 7C is a cross-sectional view of the bottom frame member 722 of FIG. 7A. The floating sill 730 of FIG. 7B is shown therein. The floating sill 730 is fabricated from a ferro-magnetic material. When the bottom magnetic portion of a flap unit within the frame 720 moves towards its closed position, the floating sill(s) 730 moves up to "capture" the flap unit. More specifically, the channel 735 engages the bottom magnet end of the flap unit, holding it in a more secure position.

It is noted that a bottom end of the floating sill 730 contains a flange 734. The flange 734 extends outside of the opposing side walls 732. When the floating sill 730 rises within the recess 735 to engage the bottom end of a flap unit, the flange 734 encounters shoulders 706 protruding into a recess 725 of the bottom frame member 722. The shoulders 706 prevent the floating sill 730 from moving completely out of the recess 725.

In the pet door 700, the floating sill(s) 730 resides central to the bottom frame member 722. The magnetic connection provided by the floating sill(s) 730 holds a central area of the flap unit in the sill(s) 730 and resists pressure or vacuum created by wind, maintaining a seal. At the same time, a pet is able to nudge the flap unit open with relative ease by pushing on one of the unbiased (or at least less biased) corners of the flap unit. Thus, the holding mechanism is released only when force is applied at either the right or left bottom side of the flap, "pealing" the flap from the bottom sill 730 with ease.

It is understood that a pet may still move the flap unit and pass through the pet door by "nudging" a central portion of the flap unit. However, this will require much greater force, causing a pet to quickly self-train to nudge the flap unit in one corner or the other. This allows the flap unit to release its seal more easily.

Figure 8A:
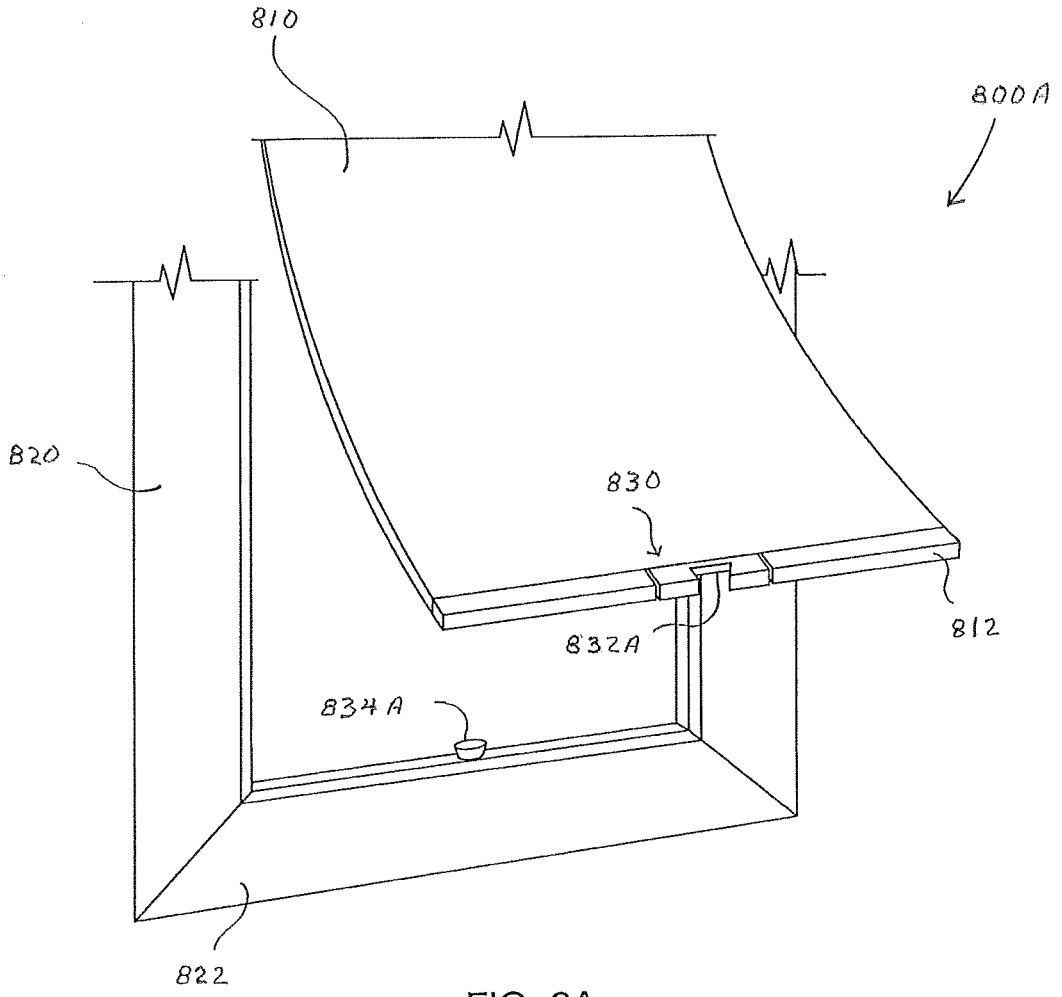
FIG. 8A is a perspective view of a lower end of a flap unit of the pet door of the present invention, in one embodiment. The lower end comprises a recess. A bottom frame member having a mating projection is shown below the flap unit.

FIG. 8A is a perspective view of a pet door 800A of the present invention, in an alternate embodiment. The pet door 800A again includes a flap unit 810 and a frame 820. Here, a lower end 812 of the flap unit 810 is seen. The lower end 812 of the flap unit 810 comprises a rail 829 having a central latch 830. The latch 830, in turn, includes a dovetailed-shaped catch or recess 832A.

The pet door 800A also includes a rounded off, dovetailed-shaped tab 834A. The tab 834A is located central to a lower or bottom frame member 822 of the frame 820. The tab 834A is configured to be received within the recess 832A. Thus, the tab 834A comprises a mating projection or profile that engages the recess 832A to secure the flap unit 810 in its closed position. As the tab 834A is rounded in shape it may be considered to be of an elliptical, frusto-conical shape.

In the arrangement of FIG. 8A, the tab 834A has a dovetail or trapezoidal profile while the recess 832A has an inverted dovetail or trapezoidal profile. Preferably, the latch 830 is a magnet while the tab 834A is fabricated from a ferro-magnetic material such as steel. Of course, the opposite could be equally functional, meaning that the tab 834A may be a magnet while the latch 830 is fabricated from a ferro-magnetic material.

It is also observed that the position of the recess 832A and the tab 834A may be reversed. Such an arrangement is shown in FIG. 8B.

Figure 8B:
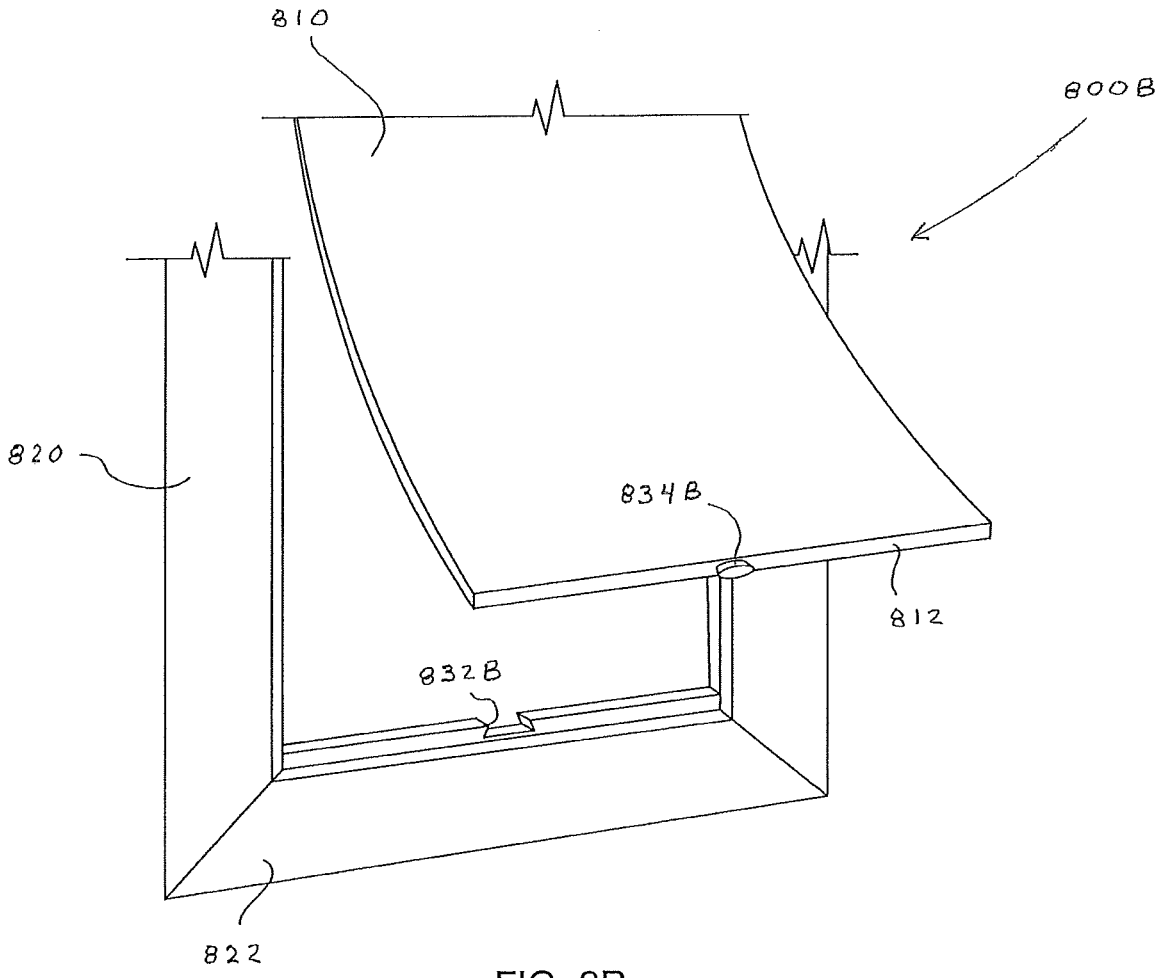
FIG. 8B is a perspective view of a lower end of a flap unit of the pet door of the present invention, in one embodiment. The lower end comprises a projection defining a tab. A bottom frame member having a mating recess is shown below the flap unit.

FIG. 8B is a perspective view of a pet door 800B of the present invention, in such an alternate embodiment. Here, it is seen that a recess 832B is placed along an upper surface of the bottom frame member 822. Reciprocally, an elliptical, frusto-conical shaped tab 834B is provided as a projection extending down from the lower end 812 of the flap unit 810, central to the flap unit 810.

Again, it is desirable that the recess 832B and the tab 834B cooperate through a magnetic attraction force. Preferably, the tab 834B is a magnet while the recess 832B is fabricated from a ferro-magnetic material. Alternatively, the recess 832B may be a magnet while the tab 834B may be fabricated from a ferro-magnetic material.

Figure 8C:
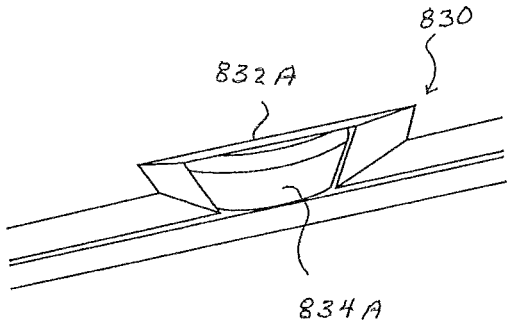
FIG. 8C shows the tab of FIG. 8A in mating contact with the recess.

FIG. 8C shows the tab 834A of FIG. 8A in mating contact with the latch 830 and recess 832A. It can be seen that a relatively close fit is provided, which in turn provides an increased level of sealing protection for the flap unit 810 against pressure differential. A stronger hold is provided central to the flap unit than to opposing lower corners.

In the arrangement of FIG. 8C, a novel holding mechanism is provided. The holding mechanism comprises a cut-out in the elongated bottom of the flap and an extending member on the frame sill. This cut-out is inventive and novel in that it includes an inverted shape that mechanically holds the flap to the sill when pressure or vacuum created by wind allowing the sill and flap to move together vertically to form a strong seal. The extending member on the frame sill will be precisely fit so a force only in the centroid of the flap will lock and continue to lock until an uneven force is applied to either corner of the elongated flap. It is understood that other shapes for the recess 832 and the tab 834 may be employed to create a magnetic holding mechanism having increased strength along a central, longitudinal axis.

Variations of the pet door and the method of installing such may fall within the spirit of the claims, below. An example of such a variation is presented in FIGS. 9A and 9B.

Figure 9A:
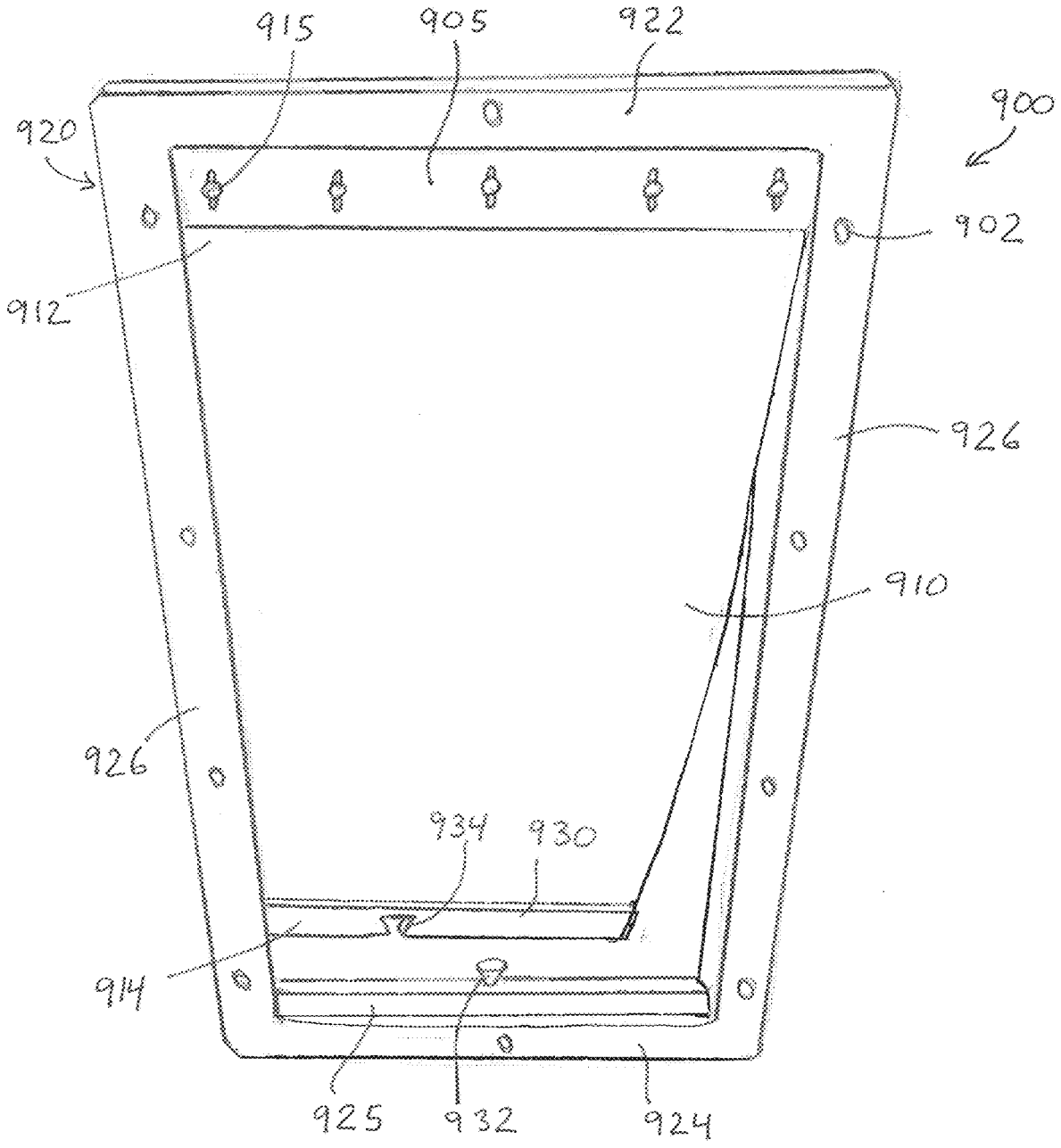
FIG. 9A is a front perspective view of a pet door of the present invention, in an alternate embodiment. Here, the tab resides along a floating sill, wherein the sill defines an elongated horizontal bar.

FIG. 9A is a front perspective view of the pet door 900 of the present invention, in an alternate embodiment. In this arrangement, the pet door 900 has a flap unit 910. The flap unit is sized to pivot into the through-opening of a barrier, such as a door. The flap unit 910 has an upper end 912 and a lower end 914. Of interest, the flap unit 910 is fabricated from a pliable material.

The pet door 900 also includes a first frame unit 920. The frame unit 920 comprises an upper frame member 922, a lower or bottom frame member 924, and opposing side members 926. The frame members 922, 924, 926 define an opening therein. The opening is configured to align with the through-opening in the door.

The pet door 900 also has at least one mechanical fastener. The mechanical fasteners may be bolts or screws. The fasteners are received within holes 902 placed around the frame members 922, 924, 926. In this way, the frame unit 920 may be secured to the door.

It is understood that the pet door 900 may, and likely will, include a second frame unit (not shown). The second frame unit will be dimensioned to generally match the first frame unit 920, just as frame units 400A and 400B of FIG. 4 have similar dimensions.

The pet door 900 further has a connection member 905. The connection member 905 connects the upper end 912 of the flap unit 910 to the upper frame member 922 of the first frame unit 910. Connection pins or screws 915 secure the flap unit 910 to the connection member 905. Because the flap unit 910 is fabricated from a pliable material, the flap unit 910 is able to pivot below the connection member 905 between open and closed positions.

The pet door 900 additionally has a moveable sill 925. The sill 925 is disposed along the lower frame member 924. In one aspect, the sill 925 defines an elongated bar configured to move vertically between a lower position wherein the sill 925 rests along the bottom frame member 924, and an upper position wherein the sill 925 moves between 2 and 20 millimeters up in the direction of the upper frame member 922. The sill 925 has inwardly turned end walls 928 which capture a T-shaped rail 929 extending upwardly from the lower frame member 924. The sill 925 has sufficient play, as shown in FIG. 9C, to allow for vertical movement and rocking or tilting movement of the sill 925 relative to the lower frame member 924.

The pet door assembly 900 also includes a tab 932. The tab 932 extends from a central portion of the sill 925 into the opening. The sill 925 includes a pair of magnets 927 with one magnet 927 positioned on each side of the tab 932.

FIG. 9B is an enlarged view of a lower portion of the pet door 900 of FIG. 9A. The floating sill 925 and connected tab 932 are more clearly seen. The sill 925 defines an elongated horizontal bar while the tab 932 has an inverted trapezoidal or elliptical frusto-conical or frusto-conical shaped profile that extends up from the bar.

The pet door 900 further has an elongated end piece or strip 930 which includes a dovetailed-shaped recess 934 and a pair of ferro-magnetic material members 931 positioned on opposite sides of the recess 934. The recess 934 is formed within a lower end of the flap unit 910 and specifically in the end strip 930. The recess 934 is dimensioned to closely receive the tab 932 as the flap unit 910 moves towards its closed position, forming a latching member. This same arrangement is shown in FIG. 8C.

In use, the flap unit 910 is biased towards its closed position by means of a magnetic attraction. In addition, the sill 925 is biased towards its upper position by means of the same magnetic attraction. Preferably, the recess 934 is configured to hold to the tab 932 and to prevent the tab 932 from releasing in response to a force applied symmetrically across the flap unit 910, but to release from the tab 932 in response to a force applied to either of the bottom corners 917 of the flap unit 910 through at least partial pivotal movement of the flap unit recess 934 relative to the tab 932.

The tilting or rocking movement of the sill 925 allows for the bellowing of the flap unit 810 due to wind or pressure differentials without releasing the flap unit 910 because of the straight on engagement of the dovetailed-shaped tab 932 within the dovetailed-shaped recess 934, i.e., the diverging sidewalls of the tab 932 remain engaged or fully captured within the diverging sidewalls of the recess 934 as the sill rocks or tilts generally to the same angle as the bellowing flap unit. The rocking movement of the sill 925 is best depicted in FIG. 9C. However, with the pet pushing upon one side or side edge of the flap unit 910 the dovetailed-shaped recess 934 pivots or rotates relative to the dovetailed-shaped tab 932 as the recess 934 is also pushed inwardly or outwardly depending on the direction of pet movement. This pivotal movement along with the inward or outward movement causes the release of the magnetic attraction between the magnet 927 and the ferro-magnetic material members 931 closest to the pet. With the release of this magnetic pull or attraction the continued movement of the pet causes the dovetailed-shaped recess 934 to slide and be disengaged from the dovetailed-shaped tab 932 through continued sliding, pivotal movement, as shown in FIG. 9B. Subsequently, the magnetic attraction between the distal pair of magnet 927 and the ferro-magnetic material members 931 is broken and the flap unit 910 is fully released from the frame 920. This side pressure upon the flap unit 910 causes only minimal tilting or rocking of the sill 925, thereby providing an quick and easy release of the dovetailed-shaped recess 934 from the dovetailed-shaped tab 932.

Again, it should be understood that the positions of the magnets 927 and the ferro-magnetic members 931 may be reversed. Also, it should be understood that the tab and recess may be made of magnetic materials as previously described in other embodiments.

It should be understood that the tab, or at least a portion of the tab, may be elliptical frusto-conical or simply frusto-conical shape to allow for relative pivotal movement of the recess therebetween. Additionally, the tab may include facets instead of a curved exterior surface. Furthermore, the top surface of the tab is generally irrelevant as it may be flat, domed shaped, recessed or any other shape. As such, as used herein, the term frusto-conical includes all these shaped and any variation thereof as at least a portion of the tab.

As the dovetailed-shaped tab and the dovetailed-shaped recess in the multiple embodiments may be reversed, each may be referred to simply as a first and/or second dovetailed-shaped latch member. Similarly, as the magnetic and the ferro-magnetic material members may be reversed, each may be referred to simply as a first and/or second magnetic member.

It will be appreciated that the inventions are susceptible to modification, variation and change without departing from the spirit thereof.

We claim:

1. A pet door, comprising:

a frame unit defining an opening therein, said frame unit having a bottom frame member;

a flap unit sized to pivot within said opening, said flap unit having an upper end pivotally coupled to said frame unit and a lower end including a first dovetailed-shaped latch member and a first magnetic member;

said bottom frame member including a second dovetailed-shaped latch member configured to engage said first dovetailed-shaped latch member and a second magnetic member magnetically attracting said first magnetic member, whereby the first and second magnetic members attract each other to aid in maintaining the flap unit in the flap unit's closed position.

2. The pet door of claim 1, wherein said second dovetailed-shaped latch member is a frusto-conical shaped tab and wherein said first dovetailed-shaped latch member is a recess configured to receive said frusto-conical shaped tab for relative pivotal movement therebetween.

3. The pet door of claim 1, wherein said bottom frame member includes a stationary portion and a moveable sill from which said second dovetailed-shaped latch member extends, said moveable sill being pivotable relative to said stationary portion.

4. The pet door of claim 3, wherein said sill is also vertically moveable relative to said stationary portion.

5. The pet door of claim 3, wherein said bottom frame member stationary portion includes a T-shaped rail, and wherein said moveable sill includes a channel configured to capture said T-shaped rail.

6. The pet door of claim 1, wherein said first magnetic member is made of a ferro-magnetic material, and wherein said second magnetic member is made of a magnetic material.

7. The pet door of claim 1, wherein said first magnetic member is comprised of two portions, wherein each first magnetic member portion is positioned to one side of said first dovetailed-shaped latch member, and wherein said second magnetic member is comprised of two portions, wherein each second magnetic member portions is positioned to one side of said second dovetailed-shaped latch member.

8. The pet door of claim 7, wherein said s dovetailed-shaped latch member is a frusto-conical shaped tab and wherein said second dovetailed-shaped latch member is a recess configured to receive said frusto-conical shaped tab for relative pivotal movement therebetween.

9. A pet door, comprising a frame unit defining an opening therein, said frame unit having a bottom frame member;

a flap unit sized to pivot within said opening, said flap unit having an upper end pivotally coupled to said frame unit and a lower end including a first dovetailed-shaped latch member, said first dovetailed-shaped latch member also being a first magnetic member;

said bottom frame member including a second dovetailed-shaped latch member configured to engage said first dovetailed-shaped latch member, said second dovetailed-shaped latch member also being a second magnetic member magnetically attracting said first magnetic member, whereby the first and second magnetic members attract each other to aid in maintaining the flap unit in the flap unit's closed position.

10. The pet door of claim 9, wherein said second dovetailed-shaped latch member is a frusto-conical shaped tab and wherein said first dovetailed-shaped latch member is a recess configured to receive said frusto-conical shaped tab for relative pivotal movement therebetween.

11. The pet door of claim 9, wherein said first dovetailed-shaped latch member is a frusto-conical shaped tab and wherein said second dovetailed-shaped latch member is a recess configured to receive said frusto-conical shaped tab for relative pivotal movement therebetween.

12. The pet door of claim 9, wherein said bottom frame member includes a stationary portion and a moveable sill from which said second dovetailed-shaped latch member extends, said moveable sill being moveable relative to said stationary portion.

13. The pet door of claim 12, wherein said sill is vertically and pivotally moveable relative to said stationary portion.

14. The pet door of claim 12, wherein said bottom frame member stationary portion includes a T-shaped rail, and wherein said moveable sill includes a channel configured to capture said T-shaped rail.

15. The pet door of claim 9 wherein said first magnetic member is made of a ferro-magnetic material, and wherein said second magnetic member is made of a magnetic material.

16. A pet door, comprising:

a frame unit defining an opening therein, said frame unit having a bottom frame member;

a flap unit sized to pivot within said opening, said flap unit having an upper end pivotally coupled to said frame unit and a lower end including a first latch member and a first magnetic member;

said bottom frame member including a second latch member configured to engage said first latch member and a second magnetic member magnetically attracting said first magnetic member, whereby the first and second magnetic members attract each other to aid in maintaining the flap unit in the flap unit's closed position, wherein said second latch member is a frusto-conical shaped tab and wherein said first latch member is a recess configured to receive said frusto-conical shaped tab for relative pivotal movement therebetween.

17. The pet door of claim 16, wherein said bottom frame member includes a stationary portion and a moveable sill from which said second latch member extends, said moveable sill being pivotable relative to said stationary portion.

18. The pet door of claim 17, wherein said sill is also vertically moveable relative to said stationary portion.

19. The pet door of claim 18, wherein said bottom frame member stationary portion includes a T-shaped rail, and wherein said moveable sill includes a channel configured to capture said T-shaped rail.

20. The pet door of claim 16 wherein said first magnetic member is made of a ferro-magnetic material, and wherein said second magnetic member is made of a magnetic material.

21. The pet door of claim 16 wherein said first magnetic member is comprised of two portions, wherein each first magnetic member portion is positioned to one side of said first latch member, and wherein said second magnetic member is comprised of two portions, wherein each second magnetic member portions is positioned to one side of said second latch member.

22. A pet door having a releasable latch, comprising:

a frame unit having an upper frame member, a lower frame member, and opposing side members, and defining an opening therein;

a flap unit sized to pivot into the through-opening, with the flap unit having an upper end and a lower end, and with the flap unit being fabricated from a pliable material;

a connection member connecting the upper end of the flap unit to the upper frame member of the first frame unit, permitting the flap unit to pivot between open and closed positions;

a sill disposed along the lower frame member, wherein the sill defines an elongated bar configured to move vertically between a lower position wherein the sill rests along the bottom frame member;

a tab extending from a central portion of the sill into the opening, wherein the tab has an inverted trapezoidal profile;

and a recess along the lower end of the flap unit and central to the flap unit, wherein the recess is dimensioned to receive the tab as the flap unit moves towards the flap unit's closed position, forming a releasable latch;

and wherein:

the flap unit is biased towards its closed position by means of a magnetic attraction; and the sill is biased towards its upper position by means of the same magnetic attraction.

23. The pet door of claim 22, wherein:

the recess is formed within the lower end of the flap unit;

and the recess is configured to hold to the tab and to prevent the flap unit from opening in response to a force applied symmetrically across the flap unit, but to release from the tab in response to a force applied to either of bottom corners of the flap unit.

* * * * *